US005980671A

United States Patent [19]

Delebassee et al.

[11] Patent Number: 5,980,671

[45] Date of Patent: Nov. 9, 1999

[54] DEVICE FOR POSITIONING, CUTTING AND DISTRIBUTING BANDS OF MATERIAL TO FORM LARGE WIDTH BANDS

[75] Inventors: Gilbert Delebassee, Perronne-En-Melantois, France; Bjorn S. Rump, Geneva, Switzerland

[73] Assignee: Sublistatic International, Henin-Beaumont, France

[21] Appl. No.: 08/190,234

[22] Filed: Feb. 1, 1994

Related U.S. Application Data

[63] Continuation of application No. 07/727,817, Jul. 8, 1991, abandoned.

[30] Foreign Application Priority Data

Jul. 6, 1990 [CH] Switzerland ..... 02251/90
Sep. 28, 1990 [FR] France ..... 90 11965

[51] Int. Cl.[6] ..... B31F 5/00

[52] U.S. Cl. ..... 156/157; 156/266; 156/304.1; 156/362; 156/502; 156/512; 156/558; 156/559

[58] Field of Search ..... 156/361, 250, 156/304.1, 353, 379, 559, 558, 502, 362, 512, 266

[56] References Cited

U.S. PATENT DOCUMENTS 3,527,633 9/1970 Bertoglio .
3,754,520 8/1973 Bennison .
4,042,440 8/1977 Hasegawa et al. .
4,081,306 3/1978 DePriest et al. .
4,411,724 10/1983 Ito et al. .
4,433,632 2/1984 Becka et al. .
4,492,609 1/1985 Blom .
4,545,845 10/1985 Biewold et al. .
4,552,602 11/1985 Landsness .
4,643,783 2/1987 Hogenson .
4,883,009 11/1989 Haselberger et al. .
4,948,445 8/1990 Hees .
5,080,154 1/1992 Kallesoe .
5,141,582 8/1992 Scott .

*Primary Examiner*—Merrick Dixon
*Attorney, Agent, or Firm*—Hodgson, Russ, Andrews, Woods & Goodyear, LLP

[57] ABSTRACT

A process and device for cutting and distributing printed large width bands and a positioning table for implementing the process.

In the extension of a feed table a positioning table is provided which is itself equipped with endless belts each carrying a gripping clip for pulling an initial band from the feed table on to itself, devices for registering and positioning the band being provided at least at the inlet and at the outlet of the positioning table.

The device allows the production of a continuous wide width printed band from a narrower width printed band assuring that the design and the pattern on the new wide width band are in perfect register as shown in FIG. 1. The device cuts a rectangular length of the original narrow band, the length being the width of the desired wide width band. The so cut rectangular sheets are joined by gluing them along the longer side of the rectangles. There is provided an arrangement to assure the perfect register (match at the joints of the printed pattern) of the resulting printing pattern. Rollers are provided to assure the crease-less or fold-less winding of the so produced wide width band.

14 Claims, 4 Drawing Sheets

Figure 1:
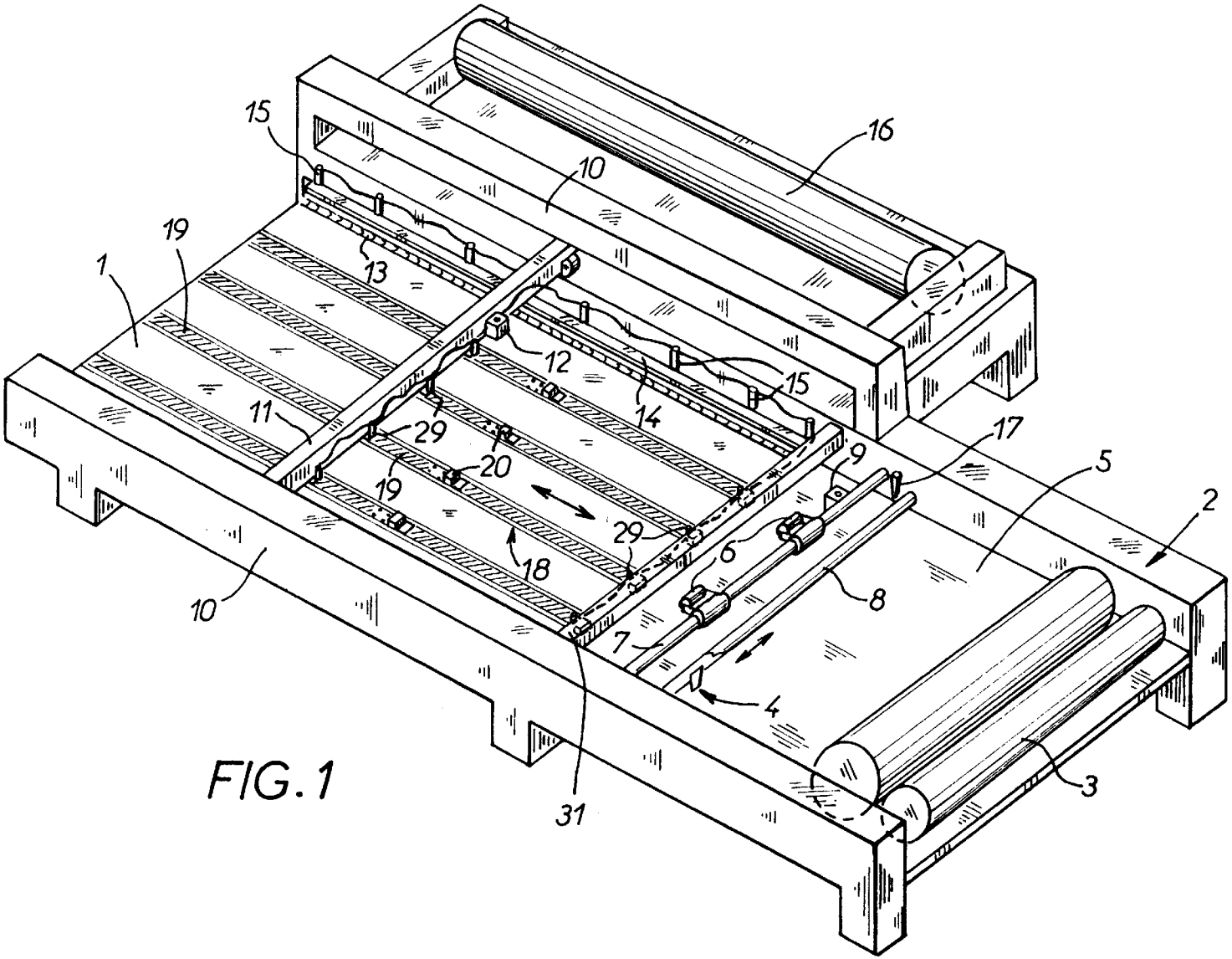

DEVICE FOR POSITIONING, CUTTING AND DISTRIBUTING BANDS OF MATERIAL TO FORM LARGE WIDTH BANDS

This is a continuation of application Ser. No. 07/727,817 filed on Jul. 8, 1991, now abandoned.

The invention, which relates to the technical field of cutting and bonding bands for forming large width printed bands, relates more precisely to the cutting and distributing process and the positioning device for implementing the process.

Printed bands for example transfer papers on which appear patterns or drawings, serve for printing large width bands.

The printing machines used up to now make possible the printing of paper bands generally having a width up to two metres, which appears sufficient. But it is clearly apparent that, with such bands, it is not possible to produce bands of a large dimension unless printing machines are constructed for this purpose, for bands of four to fives metres in width, which is not to be contemplated from an economic point of view. A solution is known which consists in using bands of conventional dimensions and assembling them together and bonding them so as to form a large width band adapted for printing a larger area. For this, an initial band carrying drawings or patterns is brought side by side with another band or with an assembly of such bands already fitted correctly together, which is again adjusted with the help of a reference mark of the relative positions of said bands, so that the drawings and patterns coincide perfectly and so that the bands may then be bonded together after adjustment.

A machine is known for implementing such a process comprising an inlet transporter means bringing an initial band perpendicularly to outlet transporter means conveying the band which is formed by sections of the initial band, the transporter means being adapted for positioning each section with the help of registry means with respect to the end of the band on the conveyor.

The registry means in question are formed of a plurality of rectangular shaped reference impressions deposited on the unprinted edges of the band. The large width band is obtained from band sections which are successively maintained in position by positioning clips. Photoelectric sensors, in a number corresponding to the registry impressions, control motors which move the positioning clips so that each section is perfectly positioned with respect to the preceding one. All that leads to a relatively complex machine, whose indexing and adjustment prove very difficult. In addition, the need to mark the registry impressions on the side of the bands complicates its manufacture. Finally, it has been observed that with such a machine the band section is not perfectly supported over the whole of its area by the mobile support which moves it and may fly up to the detriment of its correct positioning.

Such drawbacks have led the Applicant to design and perfect a particular system which very substantially improves the previously known machine, in that it appreciably simplifies the operation for locking and positioning the band sections, and in that it does away with the need to create any special registry impression on the printed band.

The invention guarantees perfect joining up of the pattern and perfect continuity in industrial production, whatever the number of bonded joints. The unwinding and winding up of the band is controlled by precise numbers and constants contained in the pattern, and the bands do not interfere with each other.

A first object of the present invention concerns then a process for continuously producing a printed pattern in a width larger than the initial width, by cutting and successively assembling initial band sections whose length corresponds to the width of the large width band, in which process the band sections are cut and successively assembled by the lateral edges along the length of the initial bands, and the new band assembled from these individual sections is wound up under the control and command of a plurality of sensors which detect the geometry of the pattern of the initial band and/or corresponding reference marks. The band is cut longitudinally before assembly so as to remove an unprinted selvedge and such cutting is made in relation with the pattern.

According to another main characteristic of the invention, the unwinding of the initial band is controlled by an automatic control and by counting the passage of reference marks under a sensor and the speed of the automatic control is slowed down after the detection of the passage of the last but one reference mark so as to stop this latter mark exactly at the predetermined position.

Advantageously, the end of the initial band is gripped by gripping means which, with respect to the automatic control speed, have a slight advance so that the band is pulled with a slight tension.

According to another particular characteristic of the invention, winding up of the large width band is automatically controlled by signals from sensors which detect the geometry of the pattern of the initial band and/or corresponding reference marks.

Another main object of the invention is to provide a device for positioning, cutting and distributing the initial bands so as to form large width bands in which, in the extension of a feed table, a positioning device is provided which is itself equipped with means for pulling an initial band from the feed table and immobilizing it, and in which the devices for registering and positioning the band are provided at least at the inlet and the outlet of the positioning device.

In a particular embodiment of the invention, the means for pulling an initial band from the feed table are formed of endless belts forming part of the positioning device and each is equipped with a gripping clip which is opened by a corresponding thrustor, said thrusters being mounted vertically in line with each belt, on a movable strut extending transversely above a positioning table, as well as on a fixed transverse beam.

Advantageously, the endless belts move in longitudinal indentations in the positioning table, flush with the level of said table or retracted below this level in the indentations.

According to a preferred embodiment, the gripping clip is formed of a base fixed to the endless belt and a central rocker hinged to said base, which ends in a pinch plate held against the belt by a spring.

According to another particular feature of the invention, the devices for registering the band are formed of a first photoelectric cell disposed at the outlet of the feed table and a second photoelectric cell located at the level of the movable strut, the second cell activating the first cell when the band arrives close to the strut and slowing down the unwinding roller of the feed table.

Figure 2:
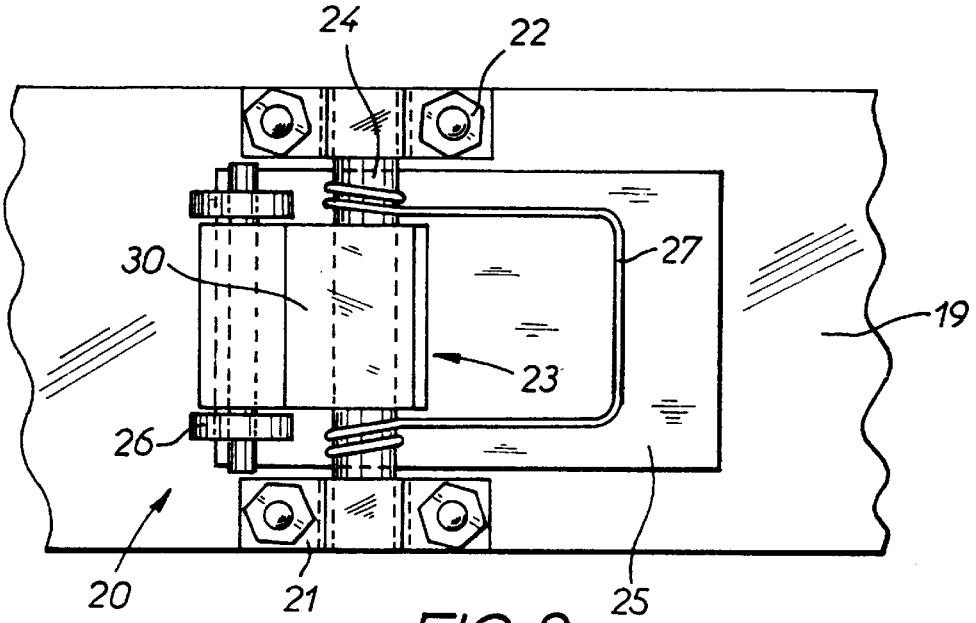
Figure 3:
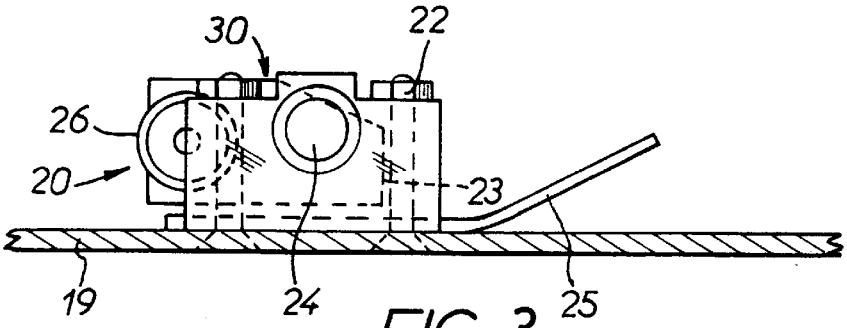
Figure 4:
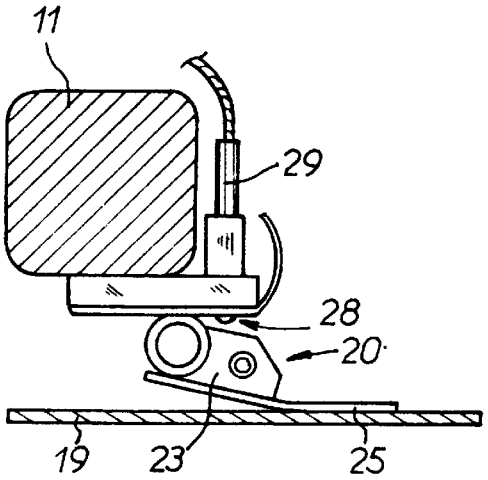
Figure 5:
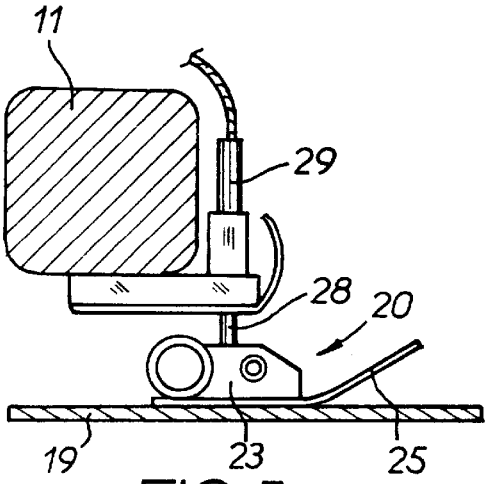
Figure 6:
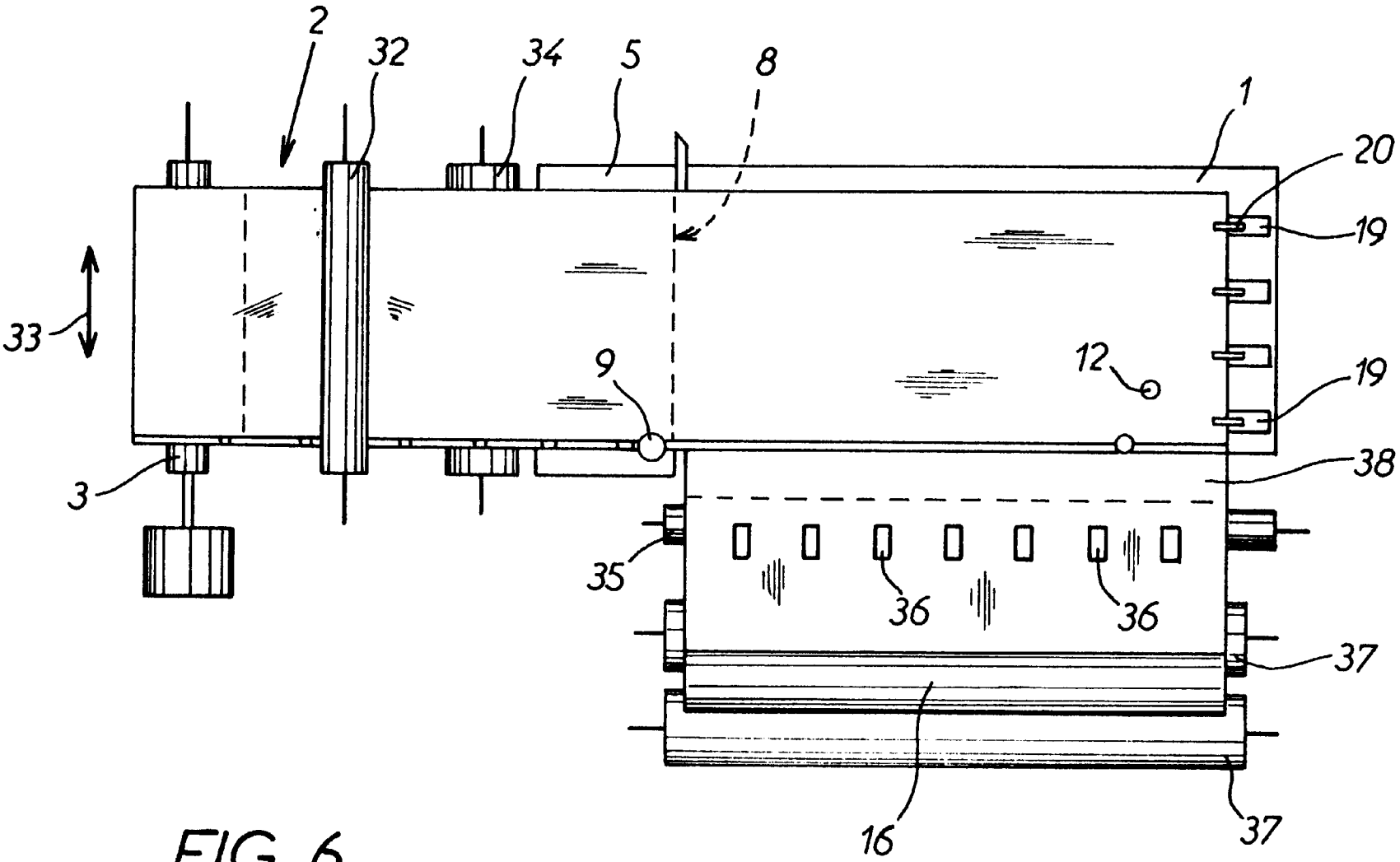
Figure 7:
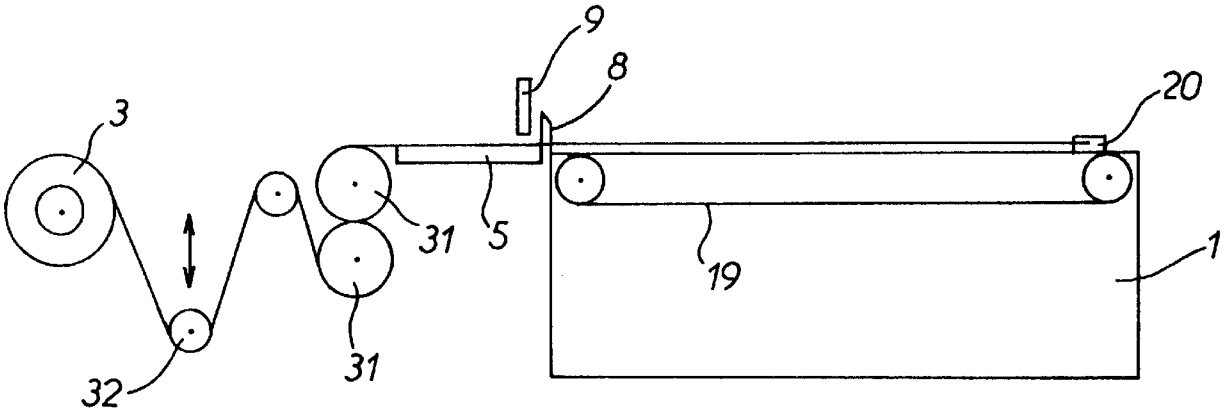
Figure 8:
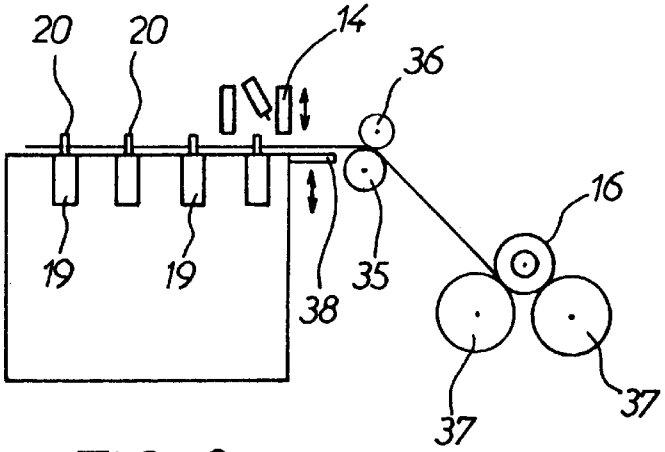

Other particular features and advantages of the invention will be clear from the following description of one embodiment taken as non limitative example, with reference to the accompanying drawings which show:

FIG. 1, a schematic perspective view of a table for positioning, cutting and distributing printed bands, FIGS. 2 and 3, top and sectional views of a gripping piece, FIGS. 4 and 5, schematic elevational views of a gripping clip in the open position and in the closed position, FIG. 6, a simplified schematic top view of the whole of the machine, FIGS. 7 and 8, respectively schematic simplified elevational side and end views of said machine.

The positioning and cutting table shown in perspective in FIG. 1, in a top view in FIG. 6 and in section in FIG. 7, is designated as a whole by the reference 1. It extends an unwinding roller 2 winding off printed band coming from a supply reel 3. The original band is pulled by drive rollers 34 (FIG. 7). The speed of the drive rollers 34 is controlled by photoelectric sensors. The position of a compensation roller 32 controls the unwinding of the printed strip from reel 3. The unwinding device also contains a means for laterally controlling the band illustrated by arrow 33 (FIG. 6) which feeds the printed band in exact and constant relation (i.e. without lateral shift on table 1).

The printed band moves flat over a feed table 5 situated at the same level as the positioning table 1.

A series of applicatory rollers 6 mounted on the same transverse cross-piece 7 hold the band in position against the table. At the frontier between the feed table and the positioning table a tube 8 extends carrying a mobile knife 4 adapted for cutting a band immobilized on the positioning table. In this outlet zone of the table is also located a photoelectric cell 9. The positioning table 1 extends over a length above to the maximum desired width of the large width band. The table is bordered longitudinally by beams forming edges 10 which serve for supporting a movable strut 11 which extends transversely like a bridge above the table. The spacing of the strut from the feed table corresponds to the width of the desired large width. The position of the strut is adjusted therefore accordingly. The strut carries a downward oriented photoelectric cell 12 for detecting the presence of a sheet. Finally, a fixed transverse beam 31 is situated just at the inlet of table 1, at a level slightly higher than its plane between the two edges 10. One of the longitudinal edges 10 is disposed slightly above the plane of the positioning table 1 to allow lateral release of a large width band towards an outlet take-up roller 16. Vertically in line with edge 10 of the table a lateral longitudinal groove 13 is provided over which a horizontal bonding bar 14 is mounted which extends over the whole length of the table, which bar can be applied on the table under the action of thrusters 15. At the inlet of the positioning table 1, above groove 13, an adhesive dispenser 17 is fixed.

The fixed positioning table 1 further has a plurality of longitudinal indentations 18, occupied by endless belts 19 which have the possibility of being flush with the level of the table but can also retract below this level into the indentations.

Whatever its position, at the level of the table or retracted into the indentations, each belt 19 has the possibility of moving longitudinally, in one direction or the other, under the action of mechanisms not shown. The purpose of the belts is to pull a band from the feed table 5 so as to place it on the positioning table 1. For this, each belt 19 is equipped with a gripping clip designated generally by the reference 20. The clip shown in greater detail in FIGS. 2 and 3 is formed of a base 21 fixed laterally to the belt by a screw-nut assembly 22 and a central rocker 23 hinged to base 21 by a horizontal shaft 24. One end of the rocker ends in a pinch plate 25, the opposite end being in the form of a cam 26. The rocker is returned by a spring 27 to the position shown in which plate 25 bears firmly on belt 19 and in which cam 26 is obviously in a top position. Zone 30, situated between the pivoting shaft 24 of clip 20 and cam 26, so in the central zone of the rocker, is advantageously profiled for receiving the end of a rod 28 of a thrustor 29 mounted vertically in line with each belt 19. A clip 20 is shown in FIG. 4 in the closed position, i.e. with its plate 25 bearing on belt 19 and in FIG. 5 the same clip in the open position because of the action of rod 28 of thrustor 29 on zone 30 of rocker 23.

Thus, the thrusters 29 are disposed vertically in line with each belt, on the one hand on the movable strut 11 and on the other on the transverse beam 31. The space of table 1 between the strut and the beam corresponds to the dimension of the large width band desired.

Belts 19 move so that each clip 20 may travel only over the distance separating the strut and the beam in an operating procedure which will be described hereafter.

Before the assembly/bonding process, the printed band must be cut at an edge at a fixed distance with respect to the pattern so that the unprinted edge is removed, so that this edge may be bonded without interruption of the pattern (with repeat). During this procedure, it is necessary to take care that appropriate means, for example by surveying and controlling the exact position of the reference marks with photoelectric cells, ensure the mentioned conditions. Such cutting of the edge may also be integrated by a man skilled in the art in the assembly device.

An initial printed band coming from the unwinding roller 2 is brought on to the feed table 5 at the edge of the positioning table 1, by passing under the transverse cross-piece 7 which holds it in position through the applicatory rollers 6. The unwinding of the initial band coming from the feed table 5 undergoes a lateral movement monitored by a photoelectric cell 39. The end of the initial band is immobilized under beam 31 after being engaged under plate 25 of each of clips 20 carried by said beam. Then, the thrusters 29 are released and the band is held attached to the belt 19 by the clips.

The belts then move in the direction of strut 11 and pull the previously immobilized band on to the positioning table. During this movement, dispenser 17 has continuously deposited a strip of adhesive on the edge of the band.

The automatic control of the band adjusts the speed thereof in accordance with a predetermined programme. The photoelectric cell 9 counts the number of repeats by means of the unwound reference marks.

After counting the passage of the last but one reference mark, the automatic controlled speed is continuously reduced, so that the last reference mark is situated exactly at the position predetermined by the photoelectric cell 12 or 9 which defines the final position of the sheet after counting and slowing down. At the beginning of and during unwinding of the band, clips 20 grip the band at the height of the cutting device 8. The advance of clips 20 is controlled in relation with the automatic control of the band so that clips 20 have a slight advance in relation to the end of the band and hold it thus under a slight tension.

Clips 20 hold the band with a possibility of slipping so that the automatic control of the band controls the final position of the band and not the advance of the clips. This unwinding arrangement guarantees, in connection with means mentioned further on, the correct unwinding of the band.

As soon as the band detected by the photoelectric cell 9 or 12 has reached the final position, device 6 or 34 or both hold the sheet for cutting by devices 4 and 8, it is then in the correct position for bonding. Device 38 is lowered and the pressure device 14 is actuated for the chosen lapse of time and is then raised because the thrusters 29 of the strut have entered into action for opening the corresponding clips. At this moment, winding up of the wide band begins over the top of the pulling cylinder, whereas belts 19 retract into the corresponding indentations 18.

During the phase for lateral release of the large width band, belts 19 return to their initial position so as to bring the clips to the level of beam 31. Since this movement takes place when the belts are retracted in indentations 18, the clips cannot grip the band. As soon as the belts have then been immobilized in the correct position, the thrusters 29 and beam 31 enter into action for opening clips 20 then closing them so as to grip a new band and the cycle is repeated.

It will be noted that the large width band is released laterally and is taken up on the output take-up roller 16.

So that winding up occurs evenly and without folds over the whole width (up to 5 metres), this new wide band is drawn off a roller 35. Pressers 36 bear with equal force (for example by means of pneumatic thrusters) on roller 35 and thus ensure the even advance of the whole band as shown in FIG. 8.

Carrier rollers 37 of the output take-up roller have also a slight circumferential speed advance with respect to that of roller 35 and thus ensure even take-up of the band.

Since the width of the original band (for example made from paper) may vary and likewise the printed pattern (for example under the influence of humidity), the means described ensure that the assembly passes correctly while complying with the take-up conditions controlled by a constant contained in the pattern.

So that the wide band taken up does not become stuck or does not brake (the result would be a slanted position of them sheet on the table) prematurely with the band which is being unwound, the primary is raised over the whole width by 1–2 cm by means of a table 38. This table 38 is lowered a little before the pressure device 14 is lowered.

After this step, the work cycle may be repeated. Practical experience has proved that the maintenance of these principles ensures that the inevitable geometric variations of the printed pattern are not accumulated during the production (assembly) and thus lead to inaccurate joining up (or to progressive shift of the pattern) but on the contrary, since the process is controlled by the pattern itself, perfect joining up is obtained even for large production lengths.

We claim:

1. Device for positioning, cutting and distributing initial bands of thin sheet material so as to form large width bands by cutting and successively assembling initial band sections whose length corresponds to the width of the large width band by cutting and successively assembling the band sections by the lateral edges along the length of the initial bands and winding up the new band assembled from these individual sections under the control and command of a plurality of sensors which detect the geometry of the pattern of the initial band and/or corresponding reference marks, said device comprising, in the extension of a feed table (5), a positioning table (1) which has an inlet adjacent said feed table and an end spaced longitudinally from said inlet and which is provided and which is itself equipped with pulling means (19) for moving longitudinally along said positioning table between said inlet and said end to pull an initial band from the feed table, releasable holding means (20) carried by said pulling means for holding an initial band at an edge thereof for pulling the band along said positioning table and operator means (29) located in spaced relation to said positioning table for engaging said holding means to place said holding means in a holding position at said inlet of said positioning table and for releasing said holding means at said end of said positioning table, and in that sensing devices (9 or 12) are provided for detecting the geometry of the pattern of the initial band and/or corresponding reference marks for registering and positioning the band at least at the inlet and the outlet of the positioning table.

2. Positioning device according to claim 1, characterized in that unwinding of the initial band from the feed table (5) undergoes a lateral movement monitored by a photoelectric cell (39) which positions the original band.

3. Positioning device according to claim 1, characterized in that the means for pulling an initial band from the feed table (5) are formed of endless belts (19) forming part of the positioning table (1) and each is equipped with said holding means comprising a gripping clip (20) which is opened by a corresponding said operator means comprising a thrustor (29), said thrusters being mounted vertically in line with each belt, on a movable strut (11) extending transversely above the positioning table, as well as on a fixed transverse beam 1311.

4. Positioning device according to claim 3, characterized in that the endless belts (19) move in longitudinal indentations (18) in the positioning table (1), flush with the level of said table or retracted below this level in the indentations.

5. Positioning device according to claims 1 or 3, characterized in that the gripping clip is formed of a base (20) fixed to the endless belt (19) and a central rocker (23) hinged to said base, which ends in a pinch plate (25) held against the belt by a spring (27).

6. Positioning device according to claims 3, characterized in that rod (28) of a thrustor (29) is applied on the control zone (30) of the rocker (23) of the gripping clip (20).

7. Positioning device according to claims 1 or 3, characterized in that the device for advancing the printed band is controlled by a first photoelectric cell (9) disposed at the outlet of the feed table (5) and a second photoelectric cell (12) located at the level of the movable strut (11).

8. Positioning device according to claim 1, characterized in that the first cell (9) activates the second cell (12) when the band arrives close to the strut (11) and sets the unwinding roller (2) of the feed table (5) to slow running.

9. Positioning device according to claims 1 or 7, characterized in that the first cell (9), after counting the reference marks, slows down the unwinding roller and detects the final position of the reference mark.

10. Positioning device according to claim 1, characterized in that a horizontal bonding bar (14) is disposed vertically in line with an edge (10) of the positioning table (1) for being applied on the table under the action of thrustors (15).

11. Positioning device according to claim 1, characterized in that the new large width band is taken up by a roller (35) associated with pressers (36) pressed with equal force by thrusters on said roller, a carrier roller is disposed laterally to the table collecting the taken-up band.

12. Positioning device according to claims 1 or 11, characterized in that a vertically movable table (38) is disposed along the positioning table for raising the free portion of the large width band.

13. Positioning device according to claims 1 or 11, characterized in that carrier rollers (37) of the output take-up roller have a slight circumferential speed advance with respect to that of roller (35) for ensuring take-up of the band.

14. Device for positioning, cutting and distributing initial bands of thin sheet material so as to form large width bands by cutting and successively assembling initial band sections whose length corresponds to the width of the large width band by cutting and successively assembling the band sections by the lateral edges along the length of the initial bands and winding up the new band assembled from these individual sections under the control and command of a plurality of sensors which detect the geometry of the pattern of the initial band and/or corresponding reference marks, said device comprising, in the extension of a feed table (5) including means (2) for advancing an initial band, a positioning table (1) which is provided and which is itself equipped with means (19, 20, 29) for gripping and pulling an initial band from the feed table, and in that first and second sensing devices (9) and (12), respectively, are provided for detecting the geometry of the pattern of the initial band and/or corresponding reference marks for registering and positioning the band at least at the inlet and the outlet of the positioning table, said advancing means being controlled by said first and second sensing devices so that prior to the initial band reaching the final position on said positioning table the control of the advancing means instead of the means for gripping and pulling determines the final position of the initial band on said positioning table.

* * * * *

UNITED STATES PATENT AND TRADEMARK OFFICE

CERTIFICATE OF CORRECTION

PATENT NO. : 5,980,671

DATED : November 9, 1999

INVENTOR(S) : Gilbert Delebassee et al.

It is certified that error appears in the above-indentified patent and that said Letters Patent is hereby corrected as shown below:

Col. 6, line 20 - "1311" should be --(31)--.

Col. 6, line 30 - "claims" should be -- claim --.

Signed and Sealed this

Eighteenth Day of July, 2000

*Attest:*

Q. TODD DICKINSON

*Attesting Officer*

*Director of Patents and Trademarks*